United States Patent [19]

Scherrer

[11] Patent Number: 4,541,428

[45] Date of Patent: Sep. 17, 1985

[54] CUTICLE CUTTING TWEEZERS WITH PROGRESSIVE CUTTING EDGE ENGAGEMENT

[76] Inventor: Hans Scherrer, Engelgasse 47, CH-4052 Basel, Switzerland

[21] Appl. No.: 468,667

[22] Filed: Feb. 22, 1983

[30] Foreign Application Priority Data

Mar. 4, 1982 [CH] Switzerland ..... 1336/82

[51] Int. Cl.[4] ..... A61F 17/32; A61B 17/30

[52] U.S. Cl. ..... 128/305; 128/354

[58] Field of Search ..... 128/354, 321, 305; 132/46, 48; 30/26, 28, 173, 175; 294/99.2

[56] References Cited

U.S. PATENT DOCUMENTS

| | | | |
|---|---|---|---|
| 691,126 | 1/1902 | Forquignon | 30/28 |
| 795,013 | 7/1905 | Weiler | 128/354 |
| 950,499 | 3/1910 | Wells | 128/354 |
| 1,286,673 | 12/1918 | Linke | 128/354 |
| 1,785,919 | 12/1930 | Stickel et al. | 128/354 |
| 1,889,475 | 11/1932 | Henkel | 128/354 |
| 2,082,062 | 6/1937 | Johnson | 128/354 |
| 2,774,138 | 12/1956 | Gowdey | 30/28 |
| 3,306,139 | 2/1967 | Brackett | 128/354 |

FOREIGN PATENT DOCUMENTS

| | | | |
|---|---|---|---|
| 375296 | 3/1964 | Switzerland | 30/175 |

*Primary Examiner*—Gene Mancene
*Assistant Examiner*—C. W. Shedd
*Attorney, Agent, or Firm*—Kenway & Jenney

[57] ABSTRACT

The tweezer legs (1) each carry, at their ends movable under spring pressure, a tweezer jaw (5) with a cutter (8). The tweezer jaws (5) and the cutters (8) are located in a mirror image opposite one another on both sides of a plane of symmetry (7') and are inclined at an angle $\alpha$ of 50°–70° in relation to an axis lying in the plane of movement (7) of the tweezer legs (1).

4 Claims, 5 Drawing Figures b

CUTICLE CUTTING TWEEZERS WITH PROGRESSIVE CUTTING EDGE ENGAGEMENT

The present invention relates to cuticle tweezers according to the pre-characterizing clause of patent claim 1.

In the care of finger nails, it is customary to remove portions of cuticle projecting from the nail surface by means of a small clipper designed to a greater or lesser extend for this purpose. However, this often presents problems because such clippers should appropriately have blades curved to match the finger surface, with the result that, in practice, the perfect manicure can only be carried out by another person. However, it is necessary for many people to be able to carry out nail care themselves unrestrictedly as regards both time and place.

It is known for use, for the cutting of finger nails, small trimming appliances which can be folded up and stored easily in any handbag. Because they have curved cutters, it is possible by means of such appliances also to cut substantial portions of cuticle projecting over a large area. Since the cutting means for shortening the finger nails have to be made relatively sturdy and appropriately wide, however, it is not possible, with these to deal with small-area and above all thin portions of cuticle.

The object of the invention is, therefore, to provide cuticle tweezers which are suitable both for left-handed and for right-handed operation, have a cutting zone which can be brought very close to the cuticle root, have a cutting blade, of which the inclination in relation to the longitudinal axis of the appliance allows treatment to be carried out in a clearly visible way, and can also be designed so that they can conveniently be carried together with other care implements.

This object is achieved, according to the invention, as defined by the characterizing features of patent claim 1. Advantageous embodiments thereof are shown in the dependent claims.

The cuticle tweezers according to the invention can be designed as an appliance which can be handled in both hands and of which the cutter, arranged obliquely in relation to the longitudinal axis lying in the actuating plane of the tweezers, can easily be brought up to the treatment surface or the treatment point.

An exemplary embodiment of the subject of the invention is explained below with reference to the drawing in which.

Figure 1:
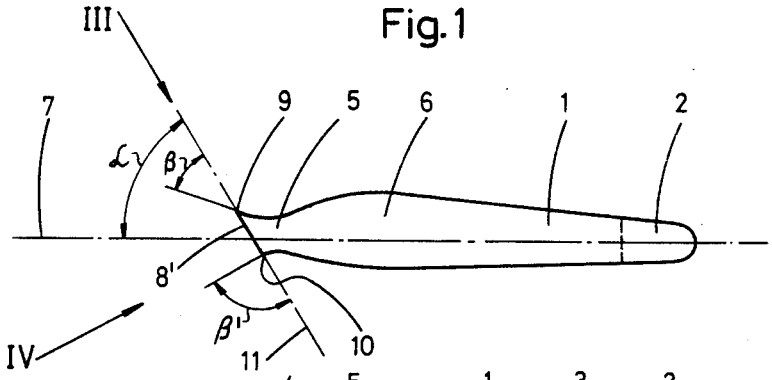
FIG. 1 shows a side view.
Figure 3A:
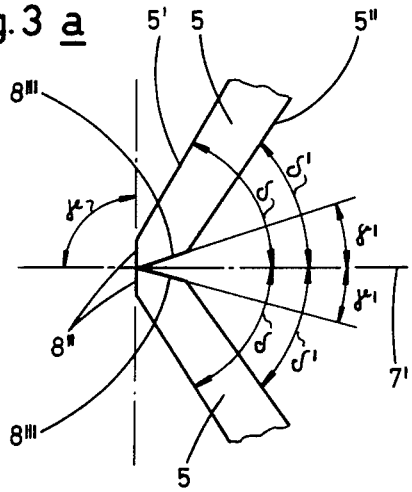
Figure 4:
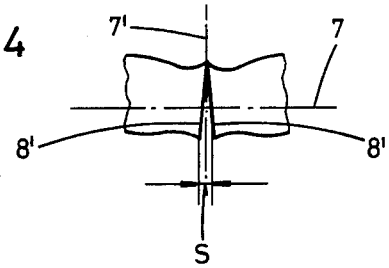

FIGS. 3*a* and 3*b* show enlarged representations of the cutters in the closed and open state, in the viewing direction III in FIG. 1, and FIG. 4 shows, likewise in an enlarged representation, the cutters in the closed and touching position, seen in the viewing direction IV in FIG. 1.

Figure 2:
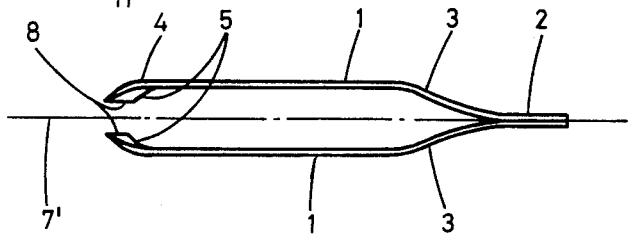
FIG. 2 shows a plan view of cuticle tweezers designed according to the invention.

The cuticle tweezers shown in FIGS. 1 and 2 consist essentially of two tweezer legs 1 which are connected firmly to one another at one end 2 by soldering, welding, riveting, etc., and which are spaced from one another, outside the connecting point, practically in a parallel relationship by means of a spreading fork 3. The other leg end 4 is bent inwards for the purpose of forming a tweezer jaw 5. The curvatures of the tweezer jaws 5 are preferably symmetrical, so that two tweezer components shaped in a mirror image are located opposite one another. The spreading fork 3 produces a resilient joint between the two tweezer legs 1, so that the tweezer jaws 5 can be engaged with one another when a pressure directed inwards is applied to the sides of the legs.

The cuticle tweezers which, when employed by the user, must be held appropriately between the thumb and the index or middle finger can be designed in the manner of slim forceps, but preferably has a widened finger pressure surface 6 in the longitudinal half directed towards the tweezer jaws 5, to allow the necessary cutting pressure to be achieved in the case of a relatively low specific surface pressure.

Figure 3A:
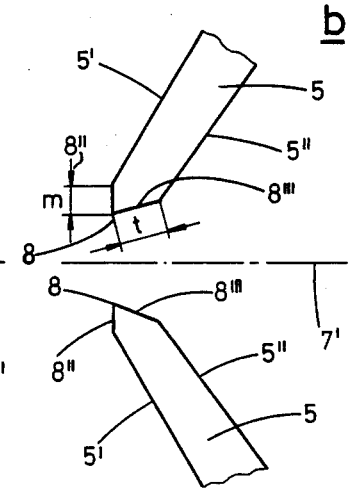

In relation to the longitudinal axis of the tweezers, which lies in the plane of movement 7 of the legs and which is shon by dot-and-dash lines in FIG. 1, the tweezer jaws 5 are inclined at an angle $\alpha$ of approximately 50°–70°, preferably approximately 60°, so as to obtain cutters 8 (FIGS. 2 and 3) extending essentially at this angle. Furthermore, the tweezer jaws 5 are designed so that the tweezer legs 1 taper at the end 4 into a cutter tip 9 at least on their side located at the top in FIG. 1. The purpose of this measure is to achieve an insertion tip, by means of which, for example, portions of cuticle adhering to the nail surface can be loosened. The respective tip angle $\beta$ appropriately measures between 35° and 55°, preferably 40°–45°. A second cutter tip 10 can be formed on the underside of the tweezer jaws, and the tip angle $\beta'$ of this is somewhat more obtuse, amounting, for example, to approximately 90°–120°, preferably 100°–110°. The tip angles $\beta$ and $\beta'$ are tangent angles between the line of alignment 11 of the tweezer jaws or cutting edges and the respective adjacent rounding-out of the tweezer legs, as shown in FIG. 1.

As illustrated in FIGS. 3*a* and 3*b*, the cutters 8 are aligned with one another on both sides of the plane of symmetry 7' of the tweezers (shown by a dot-and-dash line), which lies perpendicularly to the plane of movement 7 of the legs (FIG. 1), and butt flush against one another when the tweezers are in the completely closed state. At the same time, the distal ends of the tweezer jaws 5 are ground so that the outer cutter surface 8'' forms an angle $\gamma$ of 80°–90°, preferably at most 90°, to the plane of symmetry 7', and the inner cutter surface 8''' forms an angle $\gamma'$ of approximately 12°–20°, preferably approximately 15°, to the plane of symmetry 7'. The outer and inner cutter surfaces thus intersect at an acute angle to form a cutter edge 8'. The outer-face and inner-face portions 5' and 5'' of the tweezer jaws 5, which are adjacent to the cutters 8, form angles $\delta$ and $\delta'$ of 45°–60° and 30°–45° respectively in relation to the plane of symmetry, in such a way that a surface convergence $\delta$—$\delta'$ of approximately 5° towards the cutter 8 is produced. In view of the fact that the tweezer legs 1, made preferably from a springband or flat material, have a certain displaceability or flexibility in terms of their position perpendicular to the direction of movement of the legs, the inner cutter surface 8''' has a minimum width t of approximately 0.8–1.2 millimeters. This can ensure that even when the tweezer legs are askew at least a substantial portion of the cutter length on one leg 1 is located opposite a pronounced opposing surface on the other leg 1. To guarantee a specific shape of the cutter 8, its outer face 8'' is ground flat over a width m of approximately 0.4–0.8 millimeters.

So that a relatively high specific surface pressure can be achieved both when cuticle adhering to the nail surface is loosened and when cuticle surfaces are cut, it is appropriate if, when the tweezer legs 1 are pressed together, the cutters 8 do not rest on one another, from the outset, over their entire length. FIG. 4 shows a preferred embodiment in which the cutters 8 first come to rest on one another at the upper cutter tip 9, whilst at the same moment the lower cutter tips 10 are still apart from one another by a gap dimension s of approximately 0.2–0.5 millimeters. As a result of a progressive increase in the lateral pressure on the tweezer legs 1, the gap s closes because of their flexibility until the cutters 8 overlap completely.

The front face of the cutters 8 (the surface 8'') appropriately extends in a straight line. However, it can also have a concave or convex profile to meet special requirements.

I claim:

1. Cuticle cutting tweezers having a pair of elongate mirror image shaped tweezer legs respectively located on both sides of a plane of symmetry, being connected to one another at one end, resiliently closable together at the other end by movement in a direction substantially perpendicular to said plane, and each provided at said other end with a tweezer jaw comprising a cutter with an outer cutter surface intersecting with an inner cutter surface at an acute angle to form a cutter edge, said cutter edge extending generally transversely of said direction and being inclined at an angle of 50°–70° relative to a plane which is normal to said plane of symmetry and passes substantially through said ends, the tweezer jaws tapering toward one end of the cutter edge to intersect therewith at an angle of 35°–55° to form a cutter tip, the outer and inner cutter surfaces being formed so that as a closing force is applied to the legs to cause the cutter edges to approach one another, the cutter edges rest on one another at first only at the cutter tips, diverging from said tips with a gap that closes upon a further progressive increase in said force, butting flush against one another when the tweezers are in the completely closed state.

2. Cuticle tweezers according to claim 1, wherein each of the outer cutter surfaces forms an angle of 80°–90° relative to said plane of symmetry when the tweezers are completely closed.

3. Cuticle tweezers according to claim 2, wherein each of the inner cutter surfaces forms an angle of 12°–20° relative to said plane of symmetry when the tweezers are completely closed, and each jaw has outer and inner faces respectively intersecting with the outer and inner cutter surfaces, said outer and inner faces converging towards said plane of symmetry at an angle of approximately 5°.

4. Cuticle tweezers according to claim 3, wherein each inner cutter surface has a width of 0.8–1.2 millimeters.

* * * * *